US006250273B1

(12) United States Patent
Ryu et al.

(10) Patent No.: US 6,250,273 B1
(45) Date of Patent: Jun. 26, 2001

(54) 4-CYCLE ENGINE

(75) Inventors: Yasutake Ryu; Takao Nishida; Keita Ito, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/357,772

(22) Filed: Jul. 21, 1999

(30) Foreign Application Priority Data

Jul. 22, 1998 (JP) ..... 10-206505

(51) Int. Cl.[7] ..... F01L 1/02

(52) U.S. Cl. ..... 123/195 C; 123/90.38; 123/195 R

(58) Field of Search ..... 123/90.31, 90.38, 123/195 R, 195 C

(56) References Cited

FOREIGN PATENT DOCUMENTS 8-177441 7/1996 (JP) .

*Primary Examiner*—Noah P. Kamen

(74) *Attorney, Agent, or Firm*—Arent Fox Kintner Plotkin & Kahn

(57) ABSTRACT

A crankcase includes first and second case halves which are coupled to each other at a parting plane extending to obliquely intersect the axis of first and second bearing portions. A cylinder barrel and the first bearing portion are formed by molding integrally on the first case half to form an engine block. The second bearing portion is formed by molding integrally on the second case half and a side cover is coupled to an outer side surface of the engine block to define a valve operating chamber for accommodation of a valve operating mechanism. Thus, the distance between the first and second bearing portions for supporting opposite ends of a crankshaft can be reduced without being interfered by the valve operating mechanism, thereby enhancing the durability of the crankshaft. The valve operating mechanism can be assembled after coupling of the first and second case halves forming the crankcase, whereby the assemblability of the valve operating mechanism can be improved.

2 Claims, 6 Drawing Sheets

4-CYCLE ENGINE

BACKGROUND OF THE INVENTION

1. Field of the Invention

The present invention relates to a 4-cycle engine, particularly, an improvement in a 4-cycle engine including an engine body which is comprised of a crankcase having first and second bearing portions for supporting opposite ends of a crankshaft, and a head-integral type cylinder barrel having a cylinder bore with a piston received therein.

2. Description of the Related Art

It is known, as disclosed, for example, in Japanese Patent Application Laid-open No. 8-177441, that in a 4-cycle engine of the mentioned type, the crankcase is comprised of first and second case halves which are coupled to each other at a parting plane extending to obliquely intersect the axis of the first and second bearing portions. The cylinder barrel and the first bearing portion are formed by being integrally molded on the first case half. The second bearing half is formed by being integrally molded on the second case half.

In this type of engine, it is effective to reduce the distance as much as possible between the first and second bearing portions for supporting the opposite ends of the crankshaft, in order to alleviate the bending moment generated on the crankshaft by a load applied from the piston to the crankshaft to enhance the durability of the crankshaft.

In the above conventional engine, however, a valve operating mechanism connected to the crankshaft is disposed adjacent the inside of the second case half. For this reason, when the distance between the first and second bearing portions is to be reduced, the valve operating mechanism is an obstacle. Namely, at least one of the bearing portions cannot be disposed adjacent a crank portion of the crankshaft, because it is hindered by the valve operating mechanism. When the engine is to be assembled, a portion of the valve operating mechanism is obliged to be temporarily assembled to the crankshaft before coupling the first and second case halves to each other. Hence, it cannot be said that assembling this type of engine is easy is good.

SUMMARY OF THE INVENTION

Accordingly, it is an object of the present invention to provide a 4-cycle engine of the above-described type, wherein the distance between the first and second bearing portions supporting the opposite ends of the crankshaft is reduced without being interfered with by the valve operating mechanism. The durability of the crankshaft is thereby enhanced. Moreover, the valve operating mechanism can be assembled to the crankshaft after coupling the first and second case halves to each other, which leads to easy assembling of the engine.

To achieve the above object, according to the present invention, there is provided a 4-cycle engine comprising an engine body which is comprised of a crankcase including first and second bearing portions for supporting opposite ends of a crankshaft. A head-integral type cylinder barrel has a cylinder bore in which a piston is received. The crankcase is comprised of first and second case halves which are coupled to each other at a parting plane extending to obliquely intersect an axis of the first and second bearing portions. The cylinder barrel and the first bearing portion are formed by being integrally molded on the first case half to form an engine block. The second bearing portion is formed by being integrally molded on the second case half. A side cover is coupled to an outer side surface of the engine block which is opposite from the parting plane, so as to define a valve operating chamber for accommodation of a valve operating mechanism between the side cover and the outer side surface.

With the arrangement of the present invention, the valve operating chamber is defined between the first case half and the side cover coupled to the outer side surface of the first case half. Therefore, the first and second bearing portions formed on the first and second case halves are disposed adjacent opposite ends of a crank portion of the crankshaft, respectively, without encountering any interference by the valve operating mechanism accommodated in the valve operating chamber and the distance between the first and second bearing portions is minimized. Thus, the bending moment applied from the piston to the crankshaft is reduced to enhance the durability the crankshaft.

Moreover, even after coupling of the first and second case halves, the assembling of the valve operating mechanism can easily be carried out in a state in which the side cover has been removed.

Further, it is possible to provide a 4-cycle engine at a low cost in various forms which can be applied for various uses, only by changing the shapes of the second case half and the side cover which are relatively small parts.

The above and other objects, features and advantages of the invention will become apparent from the following description of the preferred embodiment taken in conjunction with the accompanying drawings.

DESCRIPTION OF THE PREFERRED EMBODIMENT

The present invention will now be described as being applied to a standard horizontal type 4-cycle engine with reference to FIGS. 1 to 3.

Figure 1:
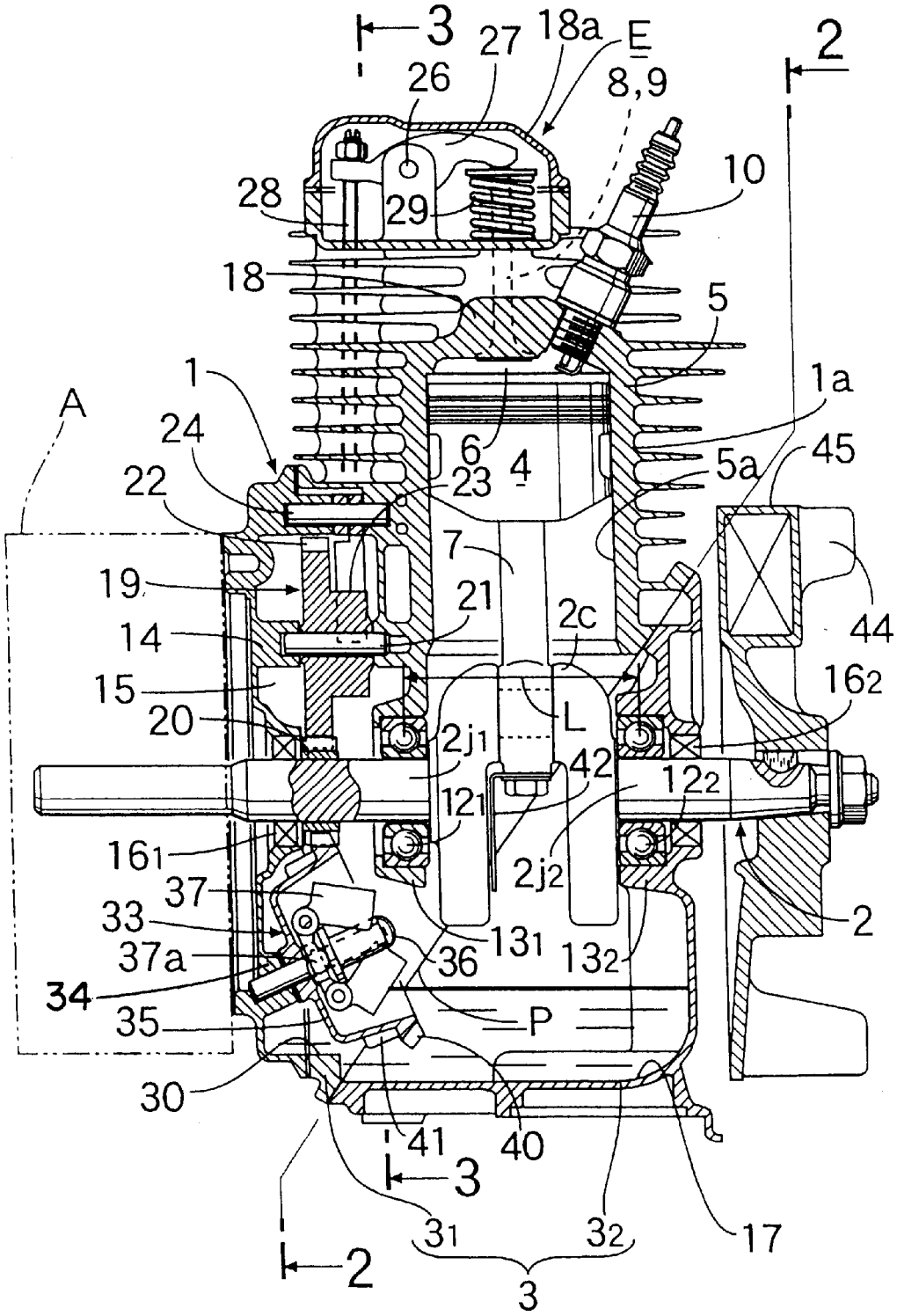
FIG. 1 is a vertical sectional front view of a 4-cycle engine formed in a standard type.
Figure 2:
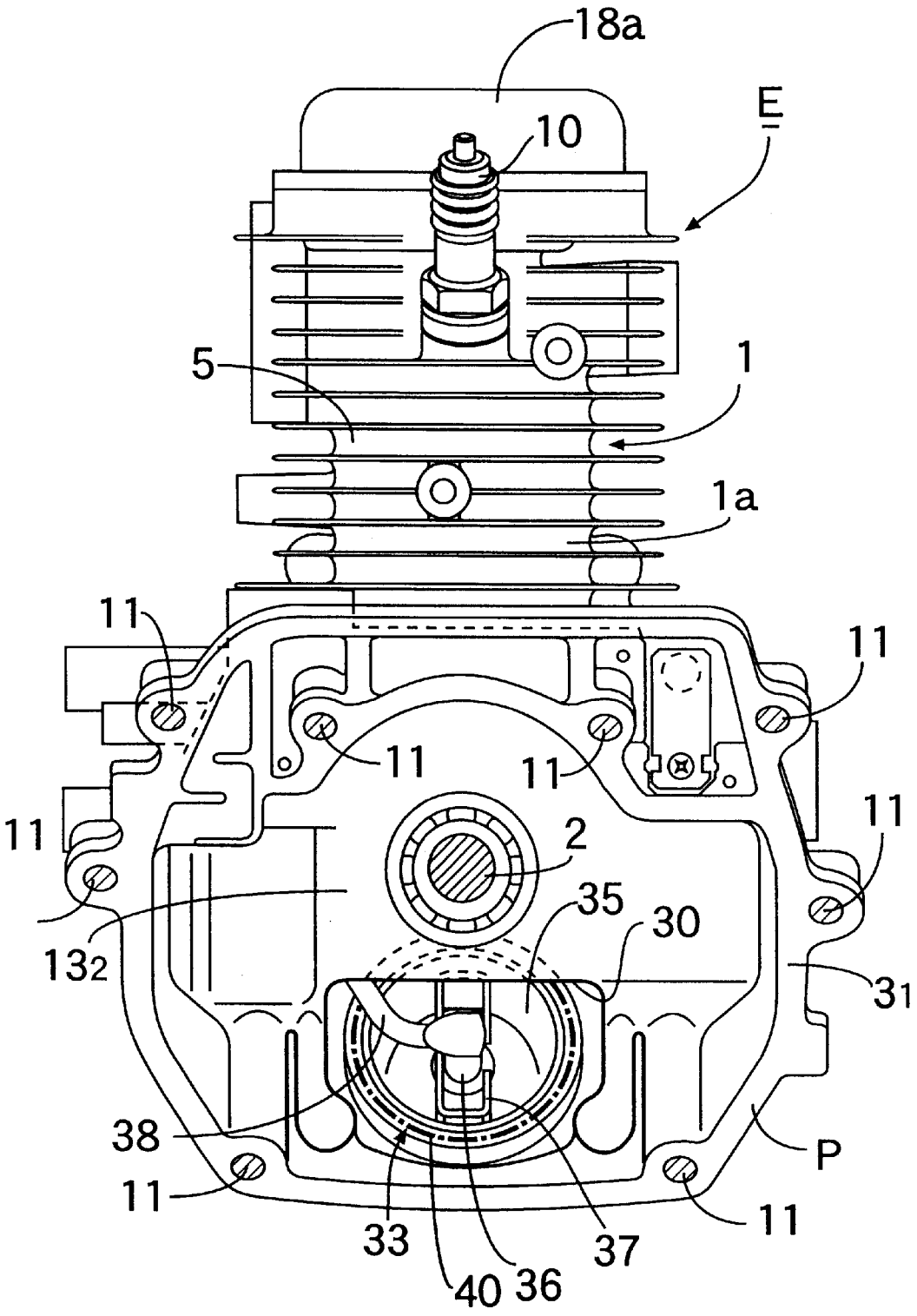
FIG. 2 is a sectional view taken along a line 2—2 in FIG. 1.

In FIGS. 1 and 2, reference character E designates a 4-cycle engine having an engine body 1. The engine body 1 comprises a crankcase 3 which supports a crankshaft 2 horizontally, a cylinder barrel 5 having a cylinder bore 5*a* in which a piston 4 is slidably received, and a cylinder head 18 which defines a combustion chamber 6 between the cylinder head 18 and a top surface of the piston 4. The crankshaft 2 has a crank portion 2*c* which is connected to the piston 4 through a connecting rod 7. Intake and exhaust valves 8 and 9 and a spark plug 10 are mounted in the cylinder head 18.

The crankcase 3 is comprised of a first case half $\mathbf{3}_1$ and a second case half $\mathbf{3}_2$ coupled to each other at a parting plane P which extends to obliquely intersect an axis of the crankshaft 2. The three following parts are formed integrally together by casting to form an engine block 1*a*: the first case half $\mathbf{3}_1$, the cylinder barrel 5 and the cylinder head 18. The first and second case halves $3_1$ and $3_2$ are separatably coupled to each other by a plurality of bolts 11 (see FIG. 2).

The crankshaft 2 includes first and second journal portions $2j_1$ and $2j_2$ formed thereon adjacent opposite sides of the crank portion 2*c*. First and second bearing portions $13_1$ and $13_2$ for supporting the first and second journal portions $2j_1$ and $2j_2$ through ball bearings $12_1$ and $12_2$ are formed by molding integrally molding them on the first and second case halves $3_1$ and $3_2$, respectively.

A side cover 14 is coupled by a plurality of bolts (not shown) to that outer side surface of the engine block 1*a* which is opposite from the parting plane P, thereby defining a valve operating chamber 15 between the side cover 14 and the outer side surface. Oil seals $16_1$ and $16_2$ are mounted respectively to the side cover 14 and the second case half $3_2$ to come into close contact with an outer peripheral surface of the crankshaft 2.

The first case half $3_1$ is provided with an opening 30 which permits the valve operating chamber 15 and the inside of the crankcase 3 to communicate with each other below the first bearing portion $13_1$. An oil reservoir 17 is defined to extend from the inside of the crankcase 3 to the valve operating chamber 15 for storing a lubricating oil in the bottom of the crankcase 3 and the valve operating chamber 15.

An upper portion of the valve operating chamber 15 extends through a sidewall of the cylinder barrel 5 to above the cylinder head 18, and an upper portion of the valve operating chamber 15 is closed by a head cover 18*a* which is coupled to an upper surface of the cylinder head 18. A valve operating mechanism 19 is disposed in the valve operating chamber 15 for opening and closing the intake and exhaust valves 8 and 9 by rotating the crankshaft 2.

Figure 3:
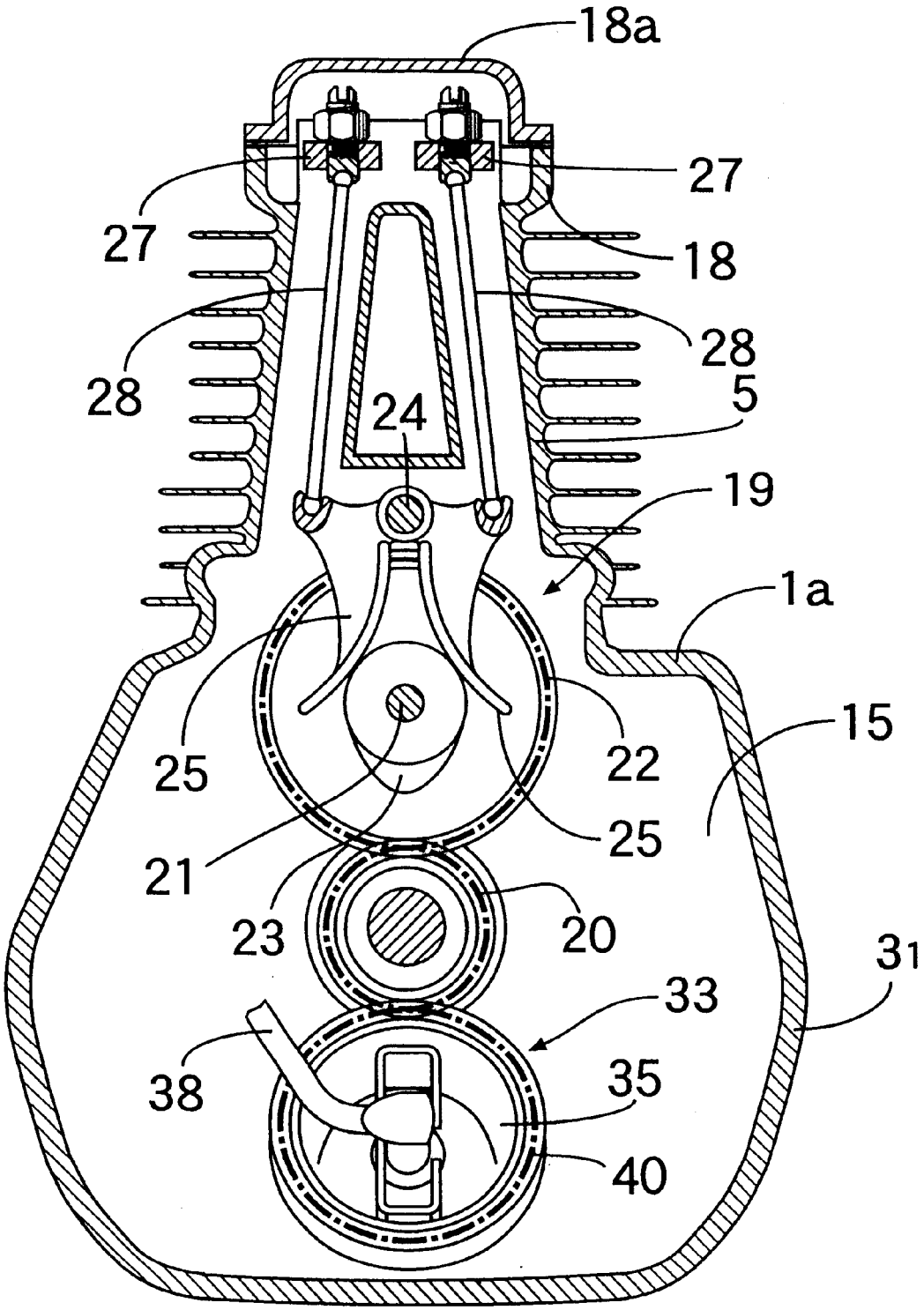
FIG. 3 is a sectional view taken along a line 3—3 in FIG. 1.

As shown in FIGS. 1 and 3, the valve operating mechanism 19 includes a drive timing gear 20 secured to the crankshaft 2 outside the first bearing portion $13_1$. A driven timing gear 22 carried on an intermediate shaft 21 and driven at a reduction ratio of one half from the drive timing gear 20. A cam 23 is connected to one end of the driven timing gear 22. A pair of cam followers 25, 25 are carried on a cam follower shaft 24 to be swung by the cam 23. A pair of rocker arms 27, 27 are carried on a rocker shaft 26 with one end thereof abutting against heads of the intake and exhaust valves 8 and 9, respectively. A pair of push rods 28, 28 connect the other ends of the rocker arms 27, 27 to the cam followers 25, 25. Valve springs 29, 29 bias the intake and exhaust valves 8 and 9 in closing directions. When the lift surface of the cam 23 pushes up the push rods 28, 28 through the cam followers 25, 25, the intake valve 8 or the exhaust valve 9 is opened. When the base surface of the cam 23 faces the cam followers 25, 25, the intake valve 8 or the exhaust valve 9 is closed by a biasing force of the valve springs 29, 29.

The intermediate shaft 21 and the cam follower shaft 24 are supported at their opposite ends by the engine block 1*a* and the side cover 14.

A regulating centrifugal governor 33 is mounted to the side cover 14 below the crankshaft 2 and driven by the drive timing gear 20. The centrifugal governor 33 is comprised of a rotary board 35 supported on a support shaft 34 fixedly mounted on an inner wall of the side cover 14. A cylindrical slider 36 is slidably fitted over the support shaft 34. A plurality of pendulum-type centrifugal weights 37 swingably are carried on the rotary board 35 with the slider 36 interposed therebetween. Each of the centrifugal weights 37 includes an operating arm 37*a* which allows the slider 36 to slide in one direction, when the centrifugal weight 37 is swung in a radially outward direction by a centrifugal force. When the slider 36 slides in the one direction, a throttle valve (not shown) of a carburetor is operated in the closing direction through a link mechanism 38, as is conventionally common, thereby controlling the engine speed to a preset value.

The support shaft 34 is fixedly mounted to the side cover 14 with an inclined attitude with its tip end directed toward the second bearing portion $13_2$, whereby the rotary board 35 is maintained in such an inclined attitude that its rotating plane is closer to the axis of the cylinder bore 5*a* toward its lower portion. The rotary board 35 is integrally formed, on an outer periphery thereof, with a driven gear 40 meshed with the drive timing gear 20, and a plurality of oil splashing blades 41 adjacent the driven gear 40. The rotary board 35 is disposed so that lower portions of the driven gear 40 and the oil splashing blades 41 are immersed in an oil in the oil reservoir 17.

As shown in FIG. 1, an oil dipper 42 is secured to a lower end of the connecting rod 7 by a bolt 43 for splashing the oil in the oil reservoir 17 by the vertical movement and swinging movement of the connecting rod 7.

A flywheel 45 having a cooling fan 44 integrally formed thereon is secured to one end of the crankshaft 2 which protrudes out of the second case half $3_2$, and a working equipment A used in a horizontal attitude, e.g., a rotor of a water pump is connected to the other end of the crankshaft 2 which protrudes out of the side cover 14.

To assemble the engine E, the ball bearings $12_1$ and $12_2$ are mounted on the first and second journals $2j_1$ and $2j_2$ of the crankshaft 2 and are fitted into the first and second bearing portions $13_1$ and $13_2$ of the first and second case halves $3_1$ and $3_2$, and the case halves $3_1$ and $3_2$ are coupled to each other by the bolts. Then, the valve operating mechanism 19 is assembled in the valve operating chamber 15 outside the first bearing portion $13_1$. Finally, the side cover 14 and the head cover 18*a* are coupled to the engine block 1*a* by the bolts. In this manner, in a state in which the first and second case halves $3_1$ and $3_2$ have been coupled to each other, and the crankshaft 2 has been reliably supported, the valve operating mechanism 19 is assembled. Therefore, it is unnecessary to perform a temporary assembling as in the prior art, leading to a easy assembling of the valve operating mechanism.

If a load is applied from the piston 4 through the connecting rod 7 to the crank portion 2*c* of the crankshaft 2 due to expansion or compression stroke during operation of the engine E, the load is supported by the first and second bearing portions $13_1$ and $13_2$ of the first and second case halves $3_1$ and $3_2$. In response to this load, a bending moment is generated in the crankshaft 2, particularly between the bearing portions $13_1$ and $13_2$. However, this bending moment is smaller, since the distance L between the bearing portions $13_1$ and $13_2$ is shorter. As described above, the valve operating mechanism 19 is disposed in the valve operating chamber 15 outside the first bearing portion $13_1$, and the bearing portions $13_1$ and $13_2$ are disposed adjacent the opposite ends of the crankshaft 2*c* without being hindered by the valve operating mechanism 19, so that the distance L between the bearing portions $13_1$ and $13_2$ is minimum. Therefore, the bending moment can be maintained to the minimum, which can contribute to an enhancement in durability of the crankshaft 2.

The centrifugal governor 33 is driven by the crankshaft 2 during operation of the engine E. Therefore, the driven gear 40 and the splashing blades 41 of the rotary board 35 splash the oil in the oil reservoir 17 upwards while agitating the oil, whereby the valve operating mechanism 19 and the other portions can be lubricated by the splashed oil.

The second case half $3_2$ and the side cover 14 are relatively small parts unlike the engine block 1*a* and hence, it is possible to provide at a low cost a 4-cycle engine E in various forms which can be applied for various uses which will be described below, only by changing the shapes and structures of the second case half $3_2$ and the side cover 14.

Figure 4:
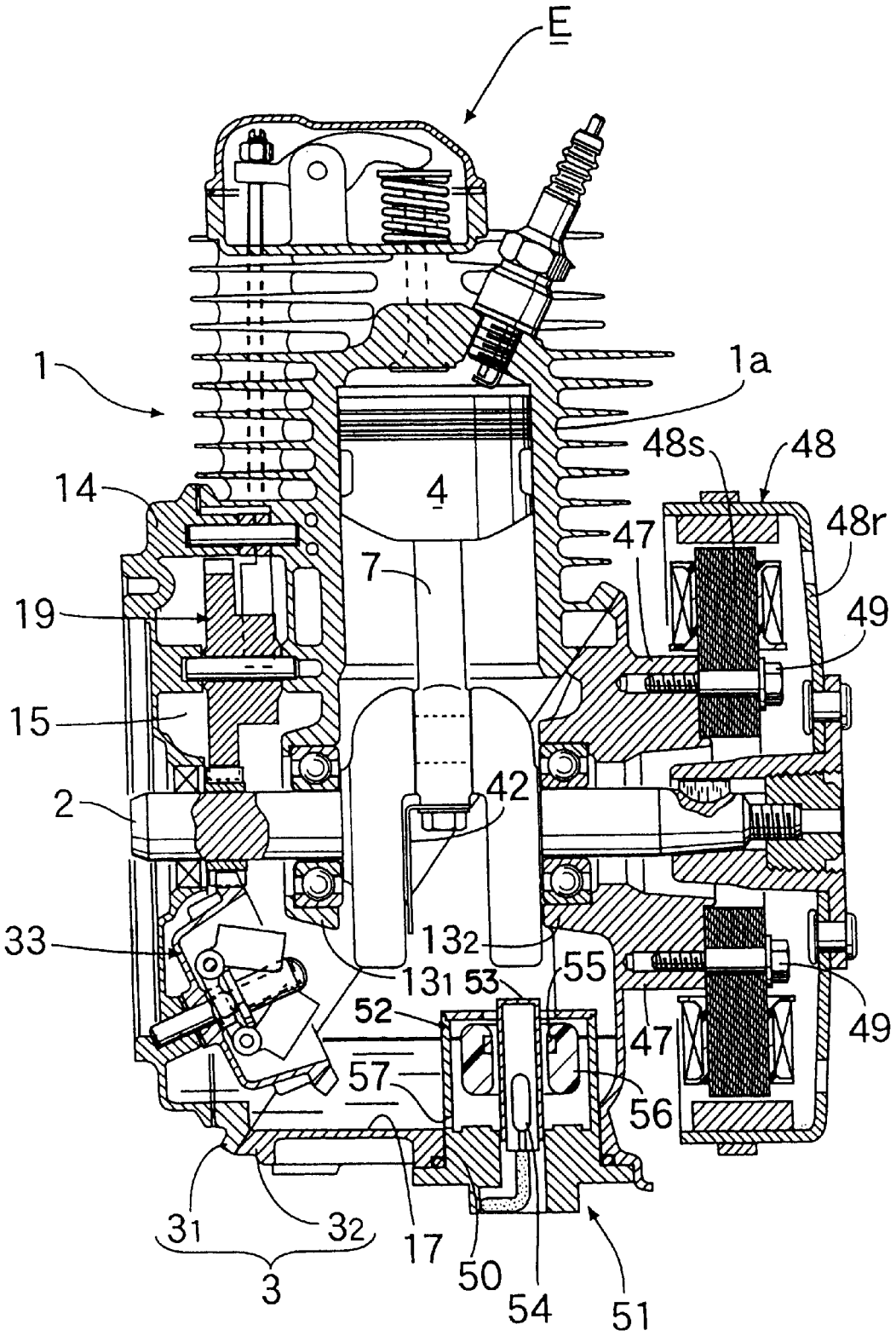
FIG. 4 is a vertical sectional front view of a 4-cycle engine formed for driving a generator.

FIG. 4 shows an example in which the second case half $3_2$ is modified, whereby the engine E is formed for driving a generator. More specifically, a plurality of stator mounting bosses 47 are integrally provided on an outer side surface of the second case half $3_2$ so as to protrude therefrom. A stator 48*s* of a generator 48 is secured to the bosses 47 by a bolt 49, and a rotor 48*r* is secured to the crankshaft 2 to surround the stator 48*s*. An alert mounting bore 50 is provided in a bottom wall of the second case half $3_2$, and a housing 52 of an oil alert 51 is mounted in the alert mounting bore 50. Thus, the rotor 48*r* can be rotated by the operation of the engine E to generate an electric power.

A liquid-tight switch tube 53 is integrally formed at a central portion of a bottom wall of the housing 52, and a lead switch 54 is accommodated within the switch tube. An annular float 56 having a permanent magnet 55 embedded in an inner peripheral surface thereof is liftably fitted over an outer periphery of the switch tube 53. The housing 52 has a through-bore 57 provided therein with its inside communicating with the oil reservoir 17 in the crankcase 3, so that the oil can flow into and out of the oil reservoir 17. Therefore, when the oil level in the oil reservoir 17 is dropped until it is equal to or lower than a defined level, the float 56 on the oil is also lowered so that the magnet 55 is closer to the lead switch 54. Thus, an alarm which is not shown can be automatically operated by closing the switch 54 due to an action of the magnetic force of the magnet 55.

Figure 5:
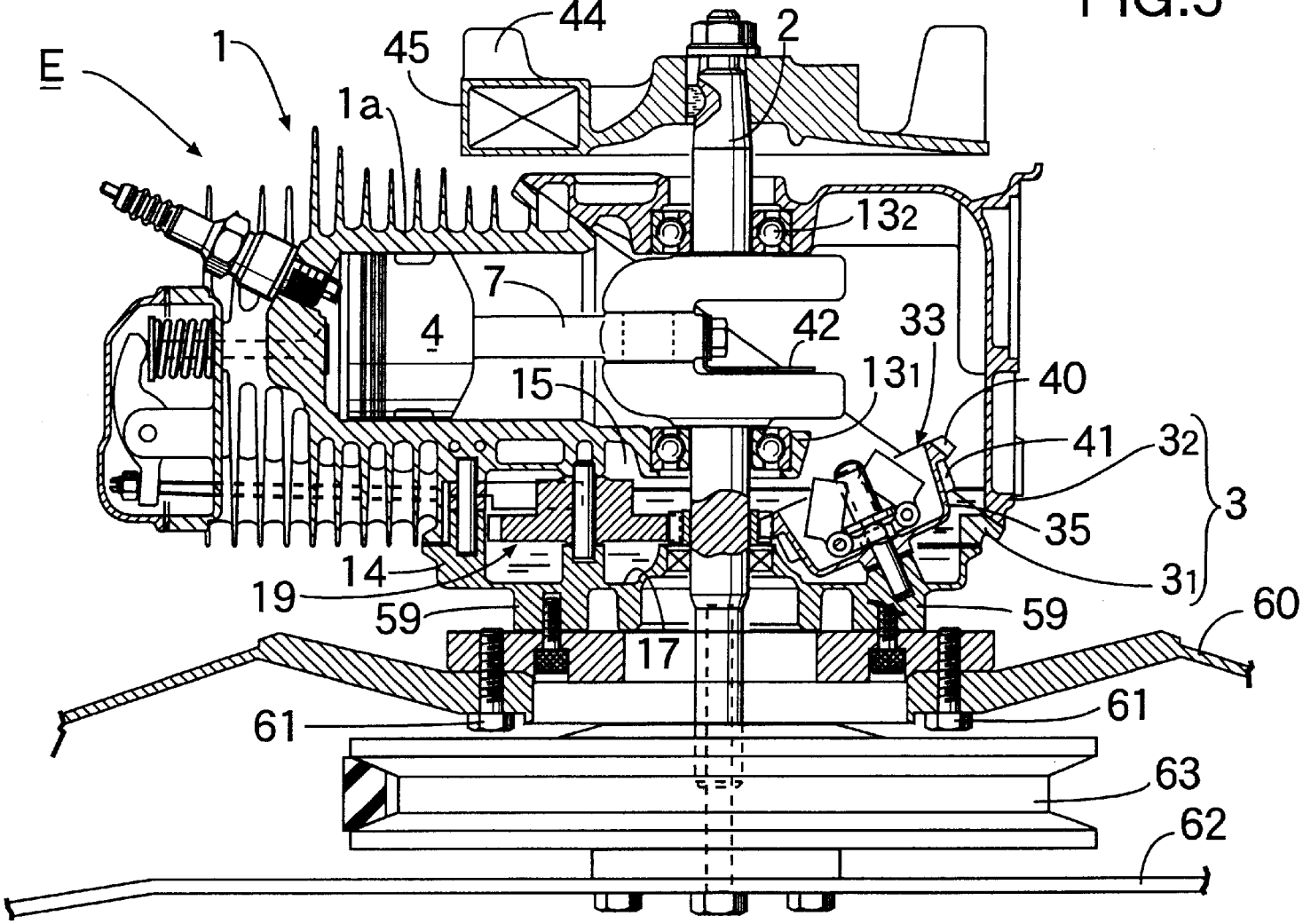
FIG. 5 is a vertical sectional front view of a 4-cycle engine formed for mowing a lawn.

FIG. 5 shows an example in which the side cover 14 is modified, whereby the engine E is formed into a vertical type for driving a lawn mower. More specifically, a plurality of housing mounting bosses 59 are integrally formed on an outer side surface of the side cover 14. The engine E is mounted on a cutting edge housing 60 for a lawn mower with the side cover 14 directed downwards, and the cutting edge housing 60 is secured to the housing mounting bosses 59 by a bolt 61. A cutting edge 62 and a driven pulley 63 for driving a driven wheel through a belt (both not shown) are mounted to the crankshaft 2 within the cutting edge housing 60.

In this way, when the engine E is used as a vertical type, the oil reservoir 17 is defined in the valve operating chamber 15 with the side cover 14 directed downwards, so that a portion of the valve operating mechanism 19 is immersed in an oil. Thus, the valve operating mechanism 19 can be lubricated without hindrance.

On the other hand, the lower portion of the centrifugal governor 33 is placed in a state in which it is still immersed in the oil of the new oil reservoir 17. Therefore, the driven gear 40 and the splashing blades 41 of the rotary board 35 splash the oil upwards while agitating the oil to reflect the oil on the inner surface of the crankcase 3, whereby the crankshaft 2 and the piston 4 as well as the portions around them can reliably be lubricated.

In a case of such vertical-type engine E, the oil dipper 42 mounted to the connecting rod 7 cannot exhibit an intrinsic oil splashing function and hence, no problem occurs even if the oil dipper 42 is removed.

Figure 6:
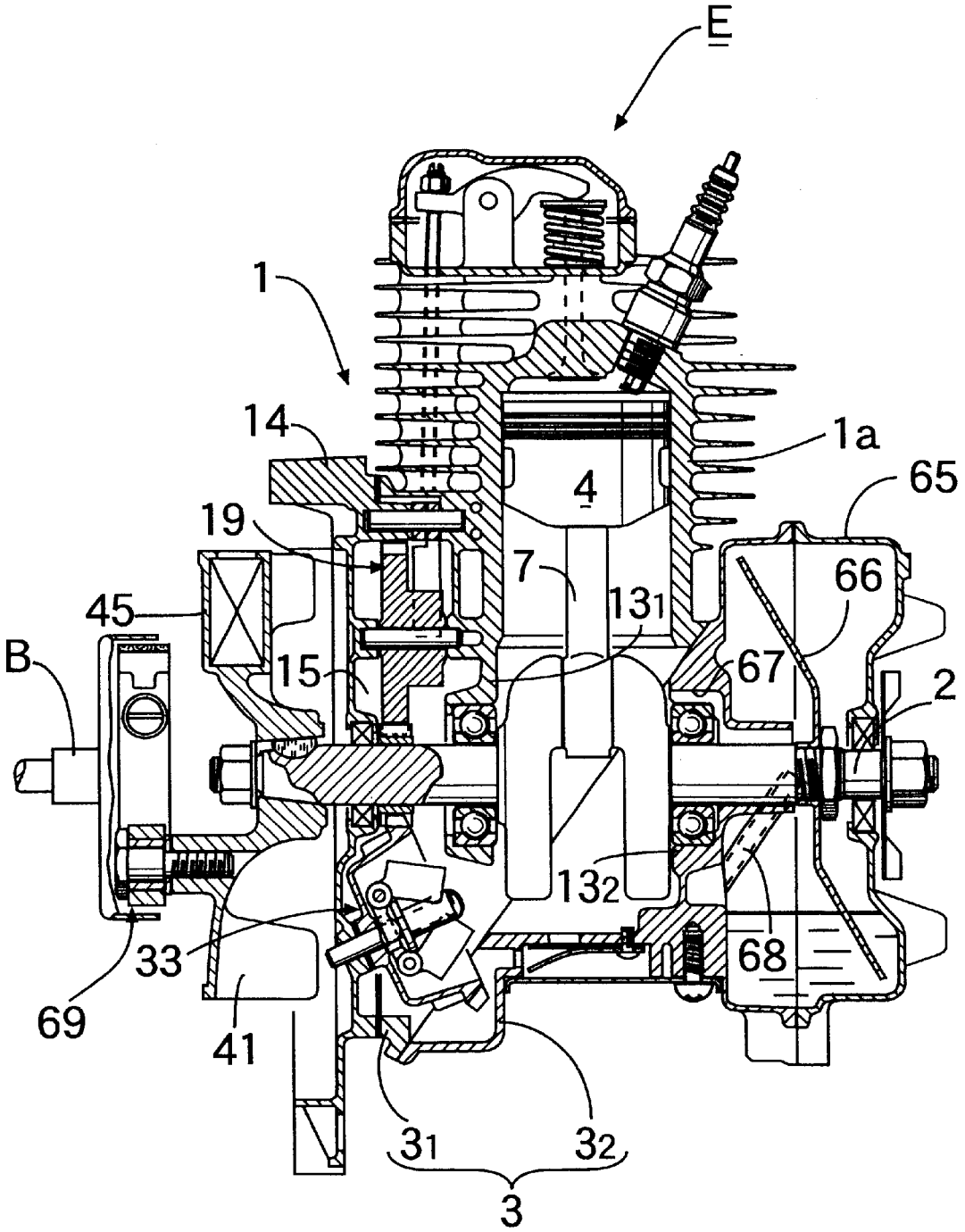
FIG. 6 is a vertical sectional front view of a 4-cycle engine formed in a hand-held type.

FIG. 6 shows an engine E which is formed into a hand-held type which drives a power trimmer, for example, by modifying the second case half $3_2$. More specifically, an oil tank 65 for storing an oil in a given amount is formed in the second case half $3_2$, and an oil slinger 66 for agitating the oil to produce an oil mist is secured to the crankshaft 2. The oil mist produced in the oil tank 65 is passed through a through-bore 67 in the second case half $3_2$ into the crankcase 3, thereby lubricating the crankshaft 2 and the piston 4 as well as the portions around them. Further, the oil mist is passed into the valve operating chamber 15 to lubricate the valve operating mechanism 19. The oil liquefied after finishing of the lubrication is returned to the oil tank 65 through a return pipe 68 provided in the second case half $3_2$. In this way, the various portions of the engine are lubricated by the oil mist and therefore, even if the engine E is used in any inclined state, the lubrication cannot be hindered.

The flywheel 45 secured to the crankshaft 2 is provided with a centrifugal clutch 69 which is operable to connect the flywheel 45 and a working machine B to each other, when the rotational speed of the crankshaft 2 is equal to or higher than a given value.

Although the embodiment of the present invention has been described in detail, it will be understood that the present invention is not limited to the above-described embodiment, and various modifications in design may be made without departing the spirit and scope of the invention defined in claims.

What is claimed is:

1. A 4-cycle engine comprising an engine body which is comprised of a crankcase including first and second bearing portions for supporting opposite ends of a crankshaft, and a head-integral type cylinder barrel having a cylinder bore in which a piston is received, wherein said crankcase is comprised of first and second case halves which are coupled to each other at a parting plane extending to obliquely intersect an axis of said first and second bearing portions, said cylinder barrel and the first bearing portion being integrally molded on said first case half to form an engine block, said second bearing portion being integrally molded on said second case half, and a side cover is coupled to an outer side surface of said engine block on a side of the engine block opposite from said parting plane, so as to define a valve operating chamber for accommodation and support of a valve operating mechanism between said side cover and said outer side surface.

2. A 4-cycle engine according to claim 1, wherein said crankshaft has a crank portion located between said first and second bearing portions, and said crankshaft further has a gear formed thereon which is associated with said valve operating mechanism, one of said first and second bearing portions being disposed between said crank portion and said gear.

* * * * *